United States Patent [19]

Dresser

[11] 3,961,602

[45] June 8, 1976

[54] BUTT COVERS

[76] Inventor: Robert E. Dresser, 173 Buena Vista Drive, Port Richey, Fla. 33568

[22] Filed: June 16, 1975

[21] Appl. No.: 587,370

[52] U.S. Cl. ..... 118/505

[51] Int. Cl.[2] ..... B05C 17/06

[58] Field of Search ..... 118/504, 505, 406, 301; 427/272, 282; 51/310–312

[56] References Cited

UNITED STATES PATENTS

| | | | |
|---|---|---|---|
| 1,843,432 | 2/1932 | Nickerson | 118/504 X |
| 2,227,453 | 1/1941 | Koch | 118/505 |
| 2,959,152 | 11/1960 | Byers et al. | 118/505 |
| 3,752,304 | 8/1973 | Alef | 118/505 X |

*Primary Examiner*—Morris Kaplan
*Attorney, Agent, or Firm*—Marden S. Gordon

[57] ABSTRACT

A protective cover intended to be applied over butt plates of door hinges to protect them from paint spray and the like while the door or door jamb are being painted, the covers consisting of a flat sheet of material having an even coating of pressure sensitive adhesive applied completely over the back surface thereof and with there being a thin sheet of protective film backing applied over the pressure sensitive adhesive to protect the same until the cover is to be used.

6 Claims, 6 Drawing Figures

BUTT COVERS

BACKGROUND OF THE INVENTION

1. Field of the Invention

This invention relates generally to painting accessories and more particularly to a novel butt cover to protect butt plates of door hinges against paint smears during the painting of the door, door jamb, and the like on which the hinges are mounted.

2. Description of the Prior Art

In the painting of a house, office building, and other structures having doors supported by hinges, it has always been a problem in the painting or staining of such doors and supporting door jambs to avoid painting the hinges mounted thereon and supporting the doors. This is presently accomplished by either the time consuming task of carefully painting around the hinges, then returning to wipe off with a rag any paint or paint splatter which inadvertently falls onto the hinge. Alternatively, the hinge is completely unscrewed or otherwise removed from the door and door jamb, the door and door jamb painted or stained in the desired manner, after which it is necessary to rescrew the hinge butt plates to the door and door jamb and rehang the door thereon. This is a time consuming and laborious task which greatly increases the overall cost of painting.

It would thus be desirable to provide a device for protecting the door hinge butt plates against paint smears and paint spray while painting.

SUMMARY OF THE INVENTION

The present invention recognizes the difficulties found in the painting or staining of a door and door jamb without getting paint or paint spray on the hinges thereof, and provides a novel solution thereto in the form of a self-adhesive sheet member of a size and configuration to be readily applied in juxtaposition to the hinge plate butt members to protect both the butt plates and the pin hole portions thereof against paint and paint spray while the door and door jamb are being painted, the covers being readily removed from their protective positions upon completion of the painting to leave a fresh looking and totally unpainted and unsmeared hinge member.

It is a feature of the present invention to provide a butt cover for the covering of door hinge members to protect them against paint and paint spray during the painting of the door and door jamb.

A further feature of the present invention provides a butt cover which is relatively simple in its construction and which, therefore, may be readily manufactured at a relatively low cost and by readily available and simple manufacturing methods so that it can be retailed at a sufficiently low price to encourage widespread use and purchase thereof.

Still a further feature of the present invention provides a butt cover as a painting accessory which is easy to use and reliable and efficient in operation.

Yet still a further feature of the present invention provides a butt cover intended to be applied to the butt plate members of a hinge with the cover being of a size and configuration adapted to readily fit on hinge members having both rectangular and curved inner corner edges.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
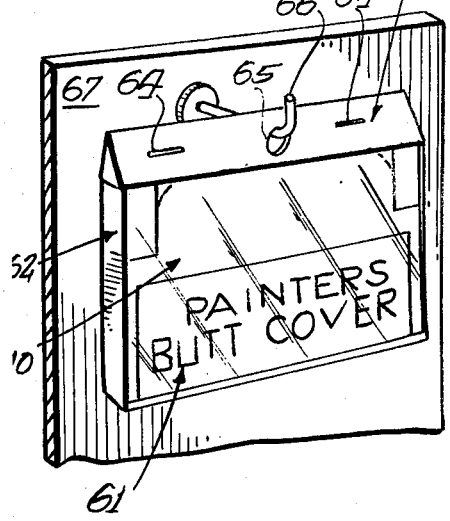
FIG. 1 is a front perspective view of a plurality of butt covers of the present invention as packaged for display and sales purposes.

Referring now to the drawings in detail, there is illustrated a preferred form of a butt cover for the covering of butt plate members of hinges, the butt cover being constructed in accordance with the principles of the present invention and being designated generally in its entirety by the reference numeral 10 and being comprised of three component parts, namely, a general T-shaped body member 11 having a coating of pressure sensitive adhesive 12 applied to a back surface thereof, the pressure sensitive coating being protected by a protective film backing sheet 13 until the butt cover is ready for use.

The body member 11 is manufactured of a thin sheet of flexible paper or plastic material and having a generl T-shaped configuration, the material being impervious to paint, and having a flat top surface 21, a flat bottom surface 22, parallel inner and outer flat edges 23 and 24. Shoulder edge 25, 25 divide the body member into an inner or butt plate portion 26 and a hinge pin hole portion 27, the butt plate portion 26 having parallel top and bottom edges 30 and 31 with the hinge pin portion 27 having top and bottom parallel flat edges 32 and 33.

A corner portion 34 is defined between edges 30 and 23, and a corner portion 35 is defined between edges 31 and 23.

The pressure sensitive adhesive coating 12 is applied completely and evenly over the back surface 22.

The protective film backing sheet 13 is of the same size and configuration as the body member 11, is manufactured of a slippery paper substance, plastic film, or the like and is disposed in face-to-face juxtaposition with back surface 22 for protecting the pressure sensitive adhesive coating 12 from coming in contact with any materials or substances until the butt cover 10 is ready to be used.

For ease of manufacture of the butt cover, and as illustrated in the drawings, it is to be noted that the butt cover is manufactured of a rectangular sheet of material of which the body member 11 is die-cut therefrom thus leaving rectangularly shaped waste segments 41 and 42 as illustrated and which stay affixed to the protective film backing sheet 13 which is also of the same rectangular configuration such that the segments are disposed with the backing sheet after the same has been removed from the body member 11 preparatory for the body member to be applied to a butt plate of a hinge member.

Figure 2:
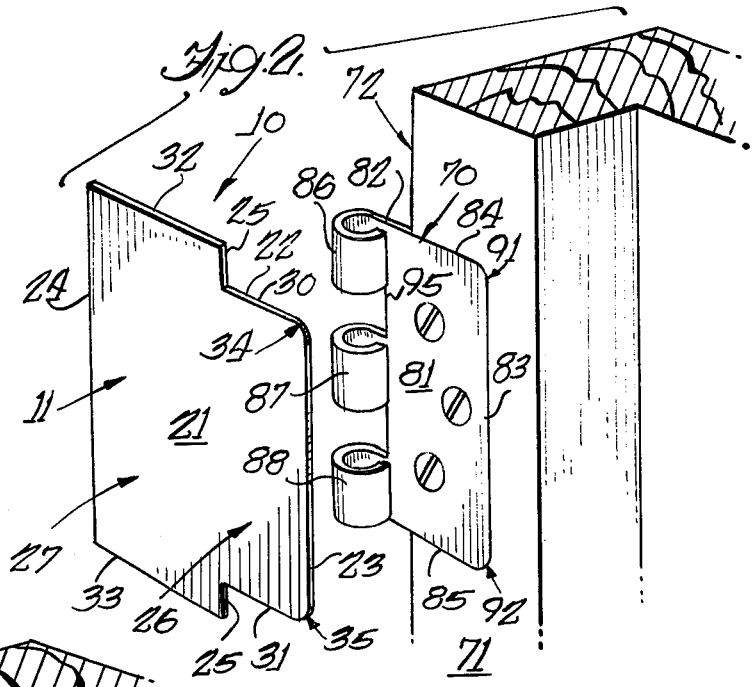
FIG. 2 is an exploded perspective view of the butt cover of the invention prior to its being applied to a butt plate of a hinge member affixed to a door jamb.
Figure 4:
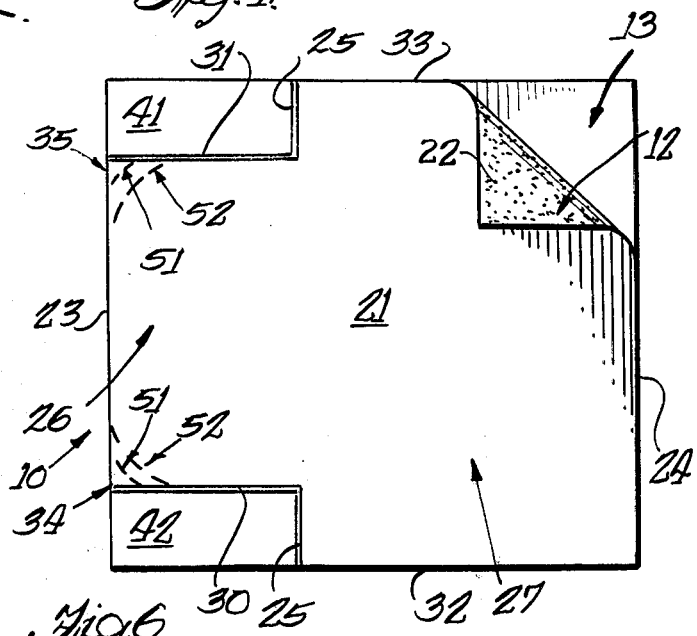
FIG. 4 is a top plan view of the butt cover of the invention having a corner thereof folded back to illustrate the pressure sensitive adhesive coating applied thereto.
Figure 5:
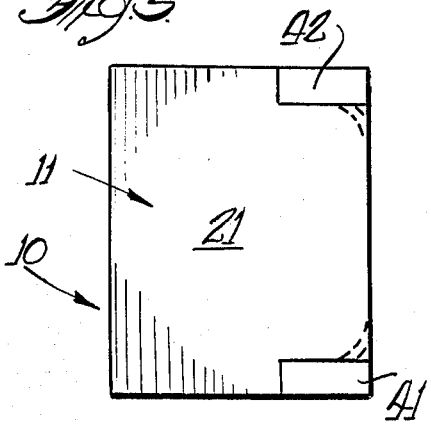
FIG. 5 is a top plan view of the butt cover similar to FIG. 4.
Figure 6:
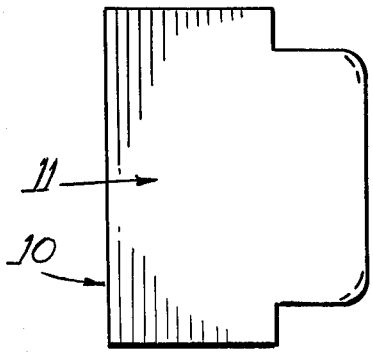
FIG. 6 is a top plan view of the butt cover itself after the protective film material backing sheet member has been removed therefrom.

In addition, it is to be noted that the corners 34 and 35 may be of a rectangular configuration, as illustrated in FIG. 4, or, alternatively, may be of a curved configuration, such as illustrated in FIG. 2, the exact shape of each of the corners being determined by the individual when peeling body member 11 from backing sheet 13 as to leaving the corners 34 and 35 rectangular or by following either of the perforated dashed score lines 51, 51 or 52, 52 disposed in opposite of the corners 34 and 35. This final selection of corner configuration 34 and 35 determined by the corner configuration of the butt plate on which the cover 10 is to be applied such that the cover fully covers the butt plate including the corners, whether the corners are square or curved, due to the general standardization of butt plates, they are either one or the other and normally conform to a specific curvature of which the score lines 51 and 52 similarly conform.

Referring to FIG. 1, there is illustrated a plurality of butt covers 10 along with an instruction card 61, all of them being disposed in parallel juxtaposition within a cellophane or plastic C-through bags 62 closed at the open top end thereof by a folded-over cardboard or paper cover 63 which is secured to the bag by suitable fastening means, such as staples 64, and which is provided centrally thereof with a circular opening 65 adapted to receive a hook member 66 therethrough for suspending the package from a display board 67 for ease of viewability and sales purposes.

Referring now to FIG. 2, there is shown, for illustrative purposes, a butt plate 70 mounted in a face surface 71 of door jamb 72 in a conventional manner and which consists of a face surface 81, a back surface 82, inner edge 83, top and bottom edges 84 and 85, and three vertically aligned cylindrical open ended members 86, 87 and 88 which are vertically spaced apart from each other. Reference numerals 91 and 92 designate the inner corners of the butt plate 70 as determined between edges 84 and 83 and edges 85 and 83 respectively.

Figure 3:
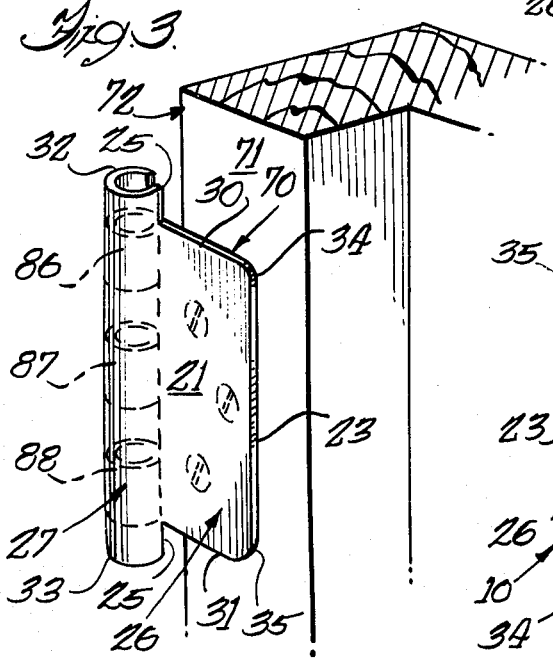
FIG. 3 is a perspective view similar to FIG. 2 and illustrating the butt cover as applied to the jamb butt plate and wrapped about the pin holes to completely protect the same.

In operation, backing sheet 13 is removed from body member 11 with corners 34 and 35 being removed from the backing sheet in the same configuration as corners 91 and 92 of the butt plate 70 on which the cover 10 is to be applied. The cover 10 is then placed directly over the butt plate 70 with butt plate portion 26 overlying butt plate face surface 81, and with hinge pin hole portion 27 overlying the cylindrical segments 86, 87 and 88. The butt plate portion 26 is then pressed onto the butt plate face surface 81 to completely cover the same with edges 25, 25 lying along outer edge 95 of the butt plate 70. The hinge pin hole portion 27 is then wrapped about the cylindrical segments 86, 87 and 88 in the manner as illustrated in FIG. 3 to completely cover the same.

The door jamb 72 may be now painted in the conventional manner with the painter being free to pass directly over the face surface 21 of cover 10 as applied to protect butt plate 70. After the paint has dried, the painter merely grasps any corner of the cover 10 and readily peels it off the butt plate 70 and throws it away, leaving a clean unpainted and unsmeared butt plate.

It is to be understood that the form of this invention herewith shown and described is to be taken as a preferred example of the same, and that this invention is not to be limited to the exact arrangement of parts shown in the accompanying drawings or described in this specification as various changes in the details of construction as to shape, size and arrangement of parts may be resorted to without departing from the spirit of the invention, the scope of the novel concepts thereof, or the scope of the sub-joined claims.

Having thus described the invention, what is claimed is:

1. A butt cover intended for protecting a butt plate of a hinge member against paint and paint sprays, the butt plate being of a flat configuration having hinge pin cylindrical receiving segments affixed thereto and projecting outwardly therefrom, the butt cover member comprising, in combination:

a thin flat flexible body member having a face surface and a back surface;

a coating of pressure sensitive adhesive applied evenly completely over the back surface of the body member;

a protective backing sheet disposed in juxtaposition with the adhesive coating back surface of the body member to protect the adhesive coating while being readily peelable therefrom to expose the adhesive coating preparatory to use of the cover member;

the body member having a general T-shaped configuration with the leg of the T defining a butt plate portion and with the arm of the T defining a hinge pin hole portion, the butt plate portion being of a general rectangular configuration having a flat vertical inner edge and opposed flat horizontal top and bottom edges with the front edge of the butt plate portion formed contiguously with a back edge of the hinge pin hole portion, inner corners defined on the butt plate portion between the inner edge and the adjacent most top and bottom edges, means defining the shape of the inner edges between a square corner configuration and an arcuate curved corner configuration, the hinge pin hole portion being of a rectangular configuration of a greater vertical height than the butt plate portion with its back edge extending outwardly of the side edges of the butt plate portion to define spaced apart back edge portions, a flat outer edge portion extending vertically parallel to the butt plate portion inner edge, and opposed parallel horizontal top and bottom edges extending parallel to and spaced outwardly from the butt plate portion top and bottom edges; and the means defining the shape of the inner corner edges of the butt plate portion of the body member comprising a normally rectangular corner member, a series of generally concentric arcuate dashed score lines spaced inwardly of the body member from each of the inner corners and defining perforation lines for tearing off portions of the body member for selective adjustment of the corners to correspond to associated corners of a butt plate on which the cover member is to be detachably affixed.

2. The butt cover member as set forth in claim 1 wherein the protective film backing sheet is manufactured of a thin flat flexible member having the same size as the cover body member and provided with a flat inner surface and outer surface, the inner surface being disposed in juxtaposition with the adhesive coating of the body member back surface to protect the same, the member being readily peeled from the adhesive coating to expose the adhesive immediately prior to the affixing of the body member to a hinge butt plate to protect the same.

3. The butt cover as set forth in claim 2 wherein the body member is manufactured of a paper material which is impervious to paint.

4. The butt cover member as claimed in claim 2 wherein the body member is manufactured of a plastic material.

5. The butt cover as set forth in claim 3 wherein the protective film backing sheet is manufactured of a paper material.

6. The butt cover as set forth in claim 4 wherein the protective film backing sheet is manufactured of a plastic material.

* * * * *